US010190373B2

(12) United States Patent
Vagapov et al.

(10) Patent No.: US 10,190,373 B2
(45) Date of Patent: Jan. 29, 2019

(54) BOTTOM-HOLE FEEDING MECHANISM

(71) Applicant: Scientific and Production Enterprise Limited Liability Company BURINTEKH (BURINTEKH ltd), Ufa (RU)

(72) Inventors: Samat Yunirovich Vagapov, Ufa (RU); Gniyatulla Garifullovich Ishbaev, Ufa (RU); Ildar Ramilevich Ishmuratov, Ufa (RU); Shamil Ildarovich Almuhametov, Ufa (RU)

(73) Assignee: SCIENTIFIC AND PRODUCTION ENTERPRISE LIMITED LIABILITY COMPANY BURINTEKH (BURINTEKH LTD), UFA (RU)

( * ) Notice: Subject to any disclaimer, the term of this patent is extended or adjusted under 35 U.S.C. 154(b) by 129 days.

(21) Appl. No.: 15/183,267

(22) Filed: Jun. 15, 2016

(65) Prior Publication Data

US 2016/0369577 A1 Dec. 22, 2016

(30) Foreign Application Priority Data

Jun. 15, 2015 (RU) ..... 2015123424

(51) Int. Cl.
*E21B 17/07* (2006.01)
*E21B 7/04* (2006.01)

(52) U.S. Cl.
CPC ..... *E21B 17/076* (2013.01); *E21B 7/046* (2013.01)

(58) Field of Classification Search
CPC .. E21B 31/107; E21B 31/113; E21B 31/1135; E21B 31/005; E21B 17/07; E21B 17/073; E21B 17/076; E21B 17/05
See application file for complete search history.

(56) References Cited

U.S. PATENT DOCUMENTS

2009/0301744 A1* 12/2009 Swinford ..... E21B 4/14 173/200
2017/0058612 A1* 3/2017 Adams ..... E21B 10/322
2017/0342781 A1* 11/2017 Reimers ..... E21B 17/073

* cited by examiner

*Primary Examiner* — D. Andrews
*Assistant Examiner* — Dany E Akakpo
(74) *Attorney, Agent, or Firm* — Hayes Soloway PC

(57) ABSTRACT

A bottom-hole feeding mechanism comprising: a cylinder (1), a screw spindle (2) engaging with the cylinder (1) by means of a non-stopping splined screw pair (3), a first piston (6) received within the cylinder (1) and coupled with the screw spindle (2) and a hollow rod (8), an axial spindle (4) arranged along the cylinder (1) axis and engaging the cylinder (1) by means of an axial splined pair (5), a second piston (7) rigidly coupled with the axial spindle (4) and engaging the inner surface of the cylinder (1) and the outer surface of the hollow rod (8), wherein the hollow rod (8), the first piston (6), the second piston (7) and the cylinder (1) form a closed chamber (9) comprising a throttle (10), hydraulic channels (11) on the body of a valve (21), and a float (12).

7 Claims, 1 Drawing Sheet

BOTTOM-HOLE FEEDING MECHANISM

CROSS REFERENCE

This application claims priority to the Russian Federation application No. 2015123424, filed Jun. 15, 2015, and incorporates the entire contents thereof herein by reference.

FIELD

The invention relates to petroleum industry and can be used predominantly for drilling horizontal or substantially horizontal borehole portions where, due to significant frictional forces between the borehole wall and the drilling string, transferring axial load to the drill bit is inhibited.

Another application of the invention is drilling in conditions of strong axial and rotational vibration of the drill bit and the entire bottom-hole assembly.

BACKGROUND

A number of methods and devices aimed at combating the above effects are used in drilling.

For example, a prior art bottom-hole feeding mechanism is formed as a part of bottom-hole assembly comprising a drilling string, a drill bit, a bottom-hole motor and a telescopic system (Patent of the Russian Federation No. 2164582, E21B7/08, published on Mar. 27, 2001).

The disadvantages of the prior art solution include complexity and lack of drill bit load adjustment during drilling.

The prior art for the present invention is a bottom-hole feeding mechanism comprising a cylinder coupled with the drilling string, a piston received therein and a hollow spindle coupled therewith and coupled with a piston engaged with the inner surface of the cylinder having a hollow rod arranged along the cylinder axis. The hollow rod, the piston and the cylinder form a closed chamber containing a throttle with a parallel hydraulic channel having a spring-loaded check valve. The outer diameter of the rod differs from the outer diameter of the piston, and the connection between the spindle and the cylinder is formed by a splined non-locking screw pair (Patent of the Russian Federation No. 2439282, E21B19/08, published on Jan. 10, 2012, BM No. 1 and the Eurasian Patent No. 019323).

The prior art technical solution has the following disadvantages.

The device is not effective enough at damping axial vibrations arising during operation of the bottom-hole motor and the drill bit. Indeed, the arrangement in which the connection between the spindle and the cylinder is formed by a splined non-locking screw pair allows transferring both rotational and axial load to the splined pair, but limits device sensitivity to changes in longitudinal vibration acting on the screw spindle. It has been established that a splined pair formed with a screw surface inhibits the process of transferring axial load from the source of longitudinal vibration to the piston due to strong frictional forces between splines.

As a result, a portion of axial vibration energy and a portion of energy of single strong axial impacts arising in bottom-hole assembly elements below the device during drilling due to frictional forces in the splined screw pair are not transferred to the device piston for subsequent damping in the closed chamber throttle, but are rather transferred directly to the cylinder and further to the drilling string by frictional forces in the splined screw pair. It is apparent that said portion of axial vibration energy is not dampened in the prior art device.

Further, the device is ineffective at damping significant impact loads, both axial and rotational. Indeed, when drilling horizontal borehole portions and when axial load transfer control is difficult, the force of axial and rotational impacts can reach significant values substantially exceeding feed force achieved by the device, thus leading to the spindle being completely recessed into the cylinder. The above behavior was encountered during use of prototype in borehole conditions.

A further disadvantage of the prior art device is that significant frictional forces in the splined screw pair significantly decrease the feed force achieved by the device, thus decreasing efficiency thereof.

A technical solution that also allows damping of rotational and axial vibration due to the fact that the splined connection is formed as a splined surface is known in the art (US Patent Application No. 20080202816, Torque Converter for Use When Drilling with a Rotating Drill Bit).

However, US 20080202816 cannot generate additional axial feed force for loading the drill bit, which is a significant factor in drilling, e.g., horizontal boreholes, in which case providing load to the drill bit is inhibited due to strong frictional forces. In drilling, when calculating the load on a hydraulic jar, the said force is referred to as "pump open force", and in oil extraction using plunger sucker-rod pumps, it is referred to as "Lubinski effect". The load component is often disregarded, but it can be significant values and, therefore, should be considered while operating the disclosed device. The nature of said force is described in: 1) "The Effect of excessive pressure in pipes on operation of hydraulic jars", S. Yu. Vagapov, G. G. Ishbaev, "Drilling and Oil", No. 12, 2008; 2) "Buckling of tubing in pumping wells, its effects and means for controlling it", Arthur Lubinski, K. A. Blenkarn, SPE-672-G Document ID, Society Petroleum Engineering, 1957.

Furthermore, the prior art technical solution lacks a closed hydraulic cavity with a throttle and a check valve that would provide throttling and dissipation of energy of both axial and rotational impacts.

On the other hand, the solution with only one spindle fails to effectively dampen axial vibration caused by strong frictional forces in the splined screw connection.

Further, a technical solution allowing to use the pump open force (POF) for providing axial load to the drill bit is known in the art (Dailey CBC-THRUSTER Tool, Weatherford Drilling and Intervention). However, the prior art device cannot provide feedback between axial load to the drill bit and rotational torque due to the use of a splined connection with axial (and not screw) splines.

SUMMARY

One object of the invention is to increase efficiency of the device.

In one embodiment, the object is achieved by a bottom-hole feeding mechanism comprising: a cylinder and a screw spindle engaging with each other as a non-stopping splined screw pair; a first piston received within the cylinder and coupled with the screw spindle and a hollow rod; a closed chamber with a throttle and hydraulic channels with a check valve, said channels arranged parallel to the throttle In one embodiment, the cylinder is provided with an axial spindle arranged along the cylinder axis and with a second piston rigidly coupled therewith and engaging the inner surface of the cylinder and the outer surface of the hollow rod, and wherein the closed chamber is formed by the hollow rod, the first piston, the second piston and the cylinder, and the connection between the axial spindle and the cylinder is formed by an axial splined pair. The first piston and the second piston are engaged with each other by means of compression springs received within the closed chamber.

DETAILED DESCRIPTION

Figure 1:
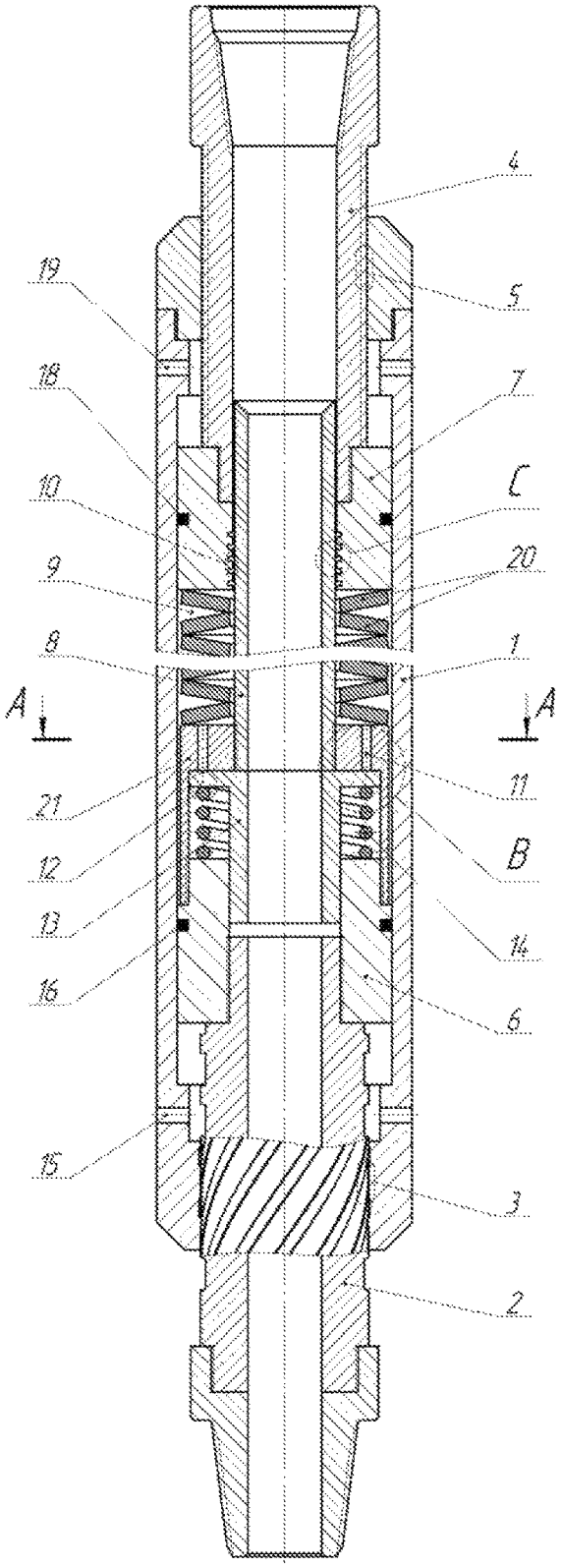
FIG. 1 depicts a longitudinal sectional view of the bottom-hole feeding mechanism, wherein elements are arranged in accordance with conventional drilling mode.
Figure 2:
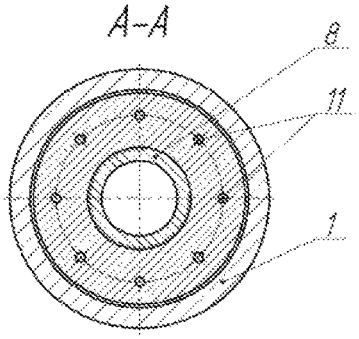
FIG. 2 depicts a cross-sectional view of the device of FIG. 1 along the A-A line.
Figure 3:
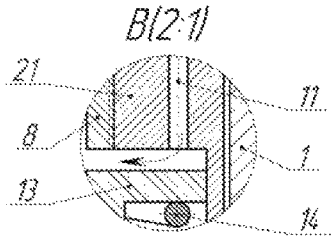
FIG. 3 depicts a check valve (scale 2:1) of the device of FIG. 1 in an open position.
Figure 4:
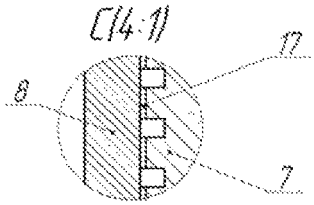
FIG. 4 depicts a throttle (scale 4:1) of the device of FIG. 1.

In one embodiment, the device comprises a cylinder 1 and a screw spindle 2 received within the cylinder 1, the spindle 2 being configured for axial displacement and engaging the cylinder 1 by means of a non-stopping splined screw pair 3. Elevation angle of the screw is selected to provide non-stopping movability, i.e., reversibility, and thus the screw spindle 2 can be displaced with respect to the cylinder 1 by both rotational torque and axial force. An axial spindle 4 is arranged on the other side of the cylinder 1 with respect to the screw spindle 2 along the axis of cylinder 1, said axial spindle 4 engaging the cylinder 1 by means of an axial splined pair 5. The screw spindle 2 comprises a first piston 6 engaging the inner surface of the cylinder 1. The axial spindle 4 comprises a second piston 7 engaging the inner surface of the cylinder 1 and the outer surface of a hollow rod 8. The first piston 6 is rigidly coupled with the hollow rod 8 arranged along the cylinder 1 axis, wherein the outer diameter of the hollow rod 8 differs from the outer diameter of the first piston 6 and differs from the outer diameter of the second piston 7. The hollow rod 8, the first piston 6, the second piston 7 and the cylinder 1 form a closed chamber 9 comprising a throttle 10, a check valve 12 comprising a stopper 13 and a spring 14 and a hydraulic channel 11 or a plurality of hydraulic channels 11 arranged parallel to the throttle 10 on a body 21 of the check valve 12. The screw spindle 2 of the device is rigidly attached to the bottom-hole structure comprising a primary element formed by a drill bit (in case of rotary drilling), a drill bit with a bottom-hole motor (in case of bottom-hole motor drilling), or a drill bit with a rotary steerable system. A vent 15 is arranged in the lower portion of the cylinder 1 below the first piston 6. The first piston 6 comprises an O-ring 16, the throttle 10 is formed by a concentric channel 17 between the hollow rod 8 and the second piston 7, said elements providing a hydraulic connection between the closed chamber 9 and the inner cavity of the device. Further, the parallel hydraulic channel 11 connects the closed chamber 9 with the inner cavity of the device. The second piston 7 comprises an o-ring 18, and a vent 19 is arranged above the second piston 7 in the cylinder 1. Compression springs 20 engaging with the first piston 6 and the second piston 7 are received within the cylinder 1.

The device is operated as follows.

The device is mounted above the bottom-hole structure on the working drilling string. Upon initiating the drilling process, a pressure differential occurs in the structure (in the drill bit, in the drill bit along with the bottomhole motor, or in the drill bit along with the rotary steerable system) located below the device, said differential acting on the first piston 6 having the O-ring 16 and on the second piston 7 having the O-ring 18, thus causing the axial spindle 4 and the screw spindle 2 to extend out of the cylinder 1 (FIG. 1). An axial force is generated and transferred to the structure below, thus generating axial load on the drill bit.

In said operating mode, when the relative displacement of the screw spindle 2 and the axial spindle 4 with respect to each other occurs at the advancement speed of the drill bit, the displacement of liquid within the concentric channel 17 of the throttle 10 occurs without a significant pressure loss and, therefore, the pressure differential acting on the pistons 6 and 7 is substantially equal to the pressure differential between the inner cavity of the device and the tubing annulus. After the screw spindle 2 and the axial spindle 4 fully exit the cylinder 1, the drilling string is inserted into the borehole from the surface and is advanced for a distance equal to the combined stroke of the screw spindle 2 and the axial spindle 4. The axial spindle 4 is inserted into the cylinder 1 and, due to the connection between the screw spindle 2 and the cylinder 1 being formed by a splined nonstopping screw pair, the screw spindle 2 is also recessed in the cylinder 1. The process is then repeated.

As noted hereinabove, when drilling horizontal or substantially horizontal borehole portions, significant frictional forces occur between the borehole wall and the drilling string, thus inhibiting the process of transferring axial load to the drill bit. On-site experience shows that the displacement of the drilling string bottom is irregular and intermittent due to inequality of static friction and dynamic friction coefficients, thus causing sudden increase in dynamic load on the elements of the bottom-hole assembly: the telescopic system, the bottom-hole motor, the rotary steerable system and the drill bit. See G. G. Ishbaev, S. Yu. Vagapov, "Modern Bottom-Hole Assembly Elements Manufactured by BURINTECH", "Drilling and Oil", No. 6, 2012; and I. R. Ishmuratov, D. S. Giniyatov, "Feed corrector/dampener manufactured by BURINTECH Research & Production Enterprise, LLC, "Drilling and Oil", No. 12, 2014.

Therefore, displacement of the axial spindle 4 and the screw spindle 2 with respect to each other and the cylinder 1 is similarly irregular and intermittent. Due to the fact that the outer diameter of the first piston 6 and that of the second piston 7 differ from the outer diameter of the hollow rod 8, a sudden intermittent change in volume of the closed chamber 9 occurs, leading to a sudden flow of working damping liquid (drilling water) along the concentric channel 17 of the throttle 10 into the inner cavity of the device. Due to friction of the liquid in the throttle 10, the energy of intermittent displacement of the drilling string bottom is absorbed and dissipated, and bottom-hole assembly elements located below the device are protected from dynamic load. In the event of a particularly strong impact exceeding a calculated value, in addition to the flow of damping working fluid, a portion of said fluid flows through the throttle 10 and through the hydraulic channel 11 or a plurality of hydraulic channels 11 arranged parallel to said throttle 10 on the body 21 of the check valve 12 after opening the stopper 13 of the check valve 12. Pressure differential value which, when reached, causes the parallel hydraulic channel 11 to open, is defined by rigidity of the spring 14 of the check valve 12, which is preset during device setup. Further, impact load is received and dampened by compression springs 20 which additionally absorb the energy of the irregular, intermittent displacement of the drilling string bottom.

In the event of an increase in rotational torque applied to the drill bit during drilling, an additional axial force is generated in the screw spindle 2 due to reactive torque acting on the non-stopping screw pair 3, said axial force directed upwards and decreasing the total feed force of the device, thus decreasing axial load on the drill bit. Said reaction of the device to an increase in rotational torque applied to the drill bit depends on the angle and direction of the screw line in the non-stopping splined screw pair 3. Said feature of the device interrupts the process of increasing rotational torque applied to the drill bit at the very beginning thereof, and the system returns to the initial state. In case when the change in torque applied to the drill bit is sudden and intermittent, the screw spindle 2 is sharply screwed into the cylinder 1 due to the effect of said impact torque. Similarly, the device thus absorbs and dissipates the energy of the rotational impact.

After the rotational torque applied to the drill bit is decreased, the screw spindle 2 gradually extends out of the cylinder 1 by means of expulsive force generated by the bottom-hole feeding mechanism and by means of elastic force of the compression springs 20, thus preventing the drill bit from hitting the bottom-hole. The gradual extension of the screw spindle 2 is achieved due to throttling of the damping working liquid as it flows through the concentric channel 17 of the throttle 10 in the opposite direction due to the fact that the check valve 12 is closed.

Longitudinal vibrations and discrete axial impacts generated by the drill bit during drilling are received by both the axial spindle 4 and the screw spindle 2 due to the fact that the connection between the screw spindle 2 and the cylinder 1 formed by a splined non-stopping screw pair 3 provides spindle displacement along device axis while being affected solely by axial force. However, due to low efficiency of the non-stopping screw pair 3 caused by high frictional forces between splines, a sudden intermittent change in volume of the closed chamber 9 in the cylinder 1 and compression of the springs 20, and therefore, absorption and dissipation of energy, occurs predominantly due to axial displacement of the axial spindle 4 with respect to the cylinder 1. It should be apparent that the reverse displacement of the device occurs due to gradual extension of the axial spindle 4 out of the cylinder 1.

Therefore, the device provided with the axial spindle 4 and the additional second piston 7 has increased sensitivity when damping longitudinal vibration in the bottom-hole assembly. It is apparent that the additional axial splined pair 5 further decreases effect of frictional forces in the non-stopping splined screw pair 3 on the feed force generated by the device. This decreased effect is achieved by exclusion of the frictional forces in the non-stopping splined pair 3 from the overall load generated by the device. Furthermore, compression springs 20 allow receiving and damping of significant axial and rotational impacts exceeding the feed force of the device.

Further, components of the feed force generated by the device are described in more detail.

The first feed force component $F_1$ is determined by the pressure differential acting on pistons 6 and 7, and is defined by the following equation:

$$F_1=(S_{cyl}-S_{rod})\cdot(P_i-P_o),$$

where $S_{cyl}$ is the cross-sectional area of the cylinder 1 taken along the inner diameter;

$S_{rod}$ is the cross-sectional area of the hollow rod 8 taken along the outer surface;

$P_i$ is the ambient pressure inside the device;

$P_o$ is the ambient pressure in the tubing annulus outside the device (defined by pressure differential in the bottom-hole assembly below the device).

The second feed force component $F_2$, determined by the Lubinski effect or the "pump open force" is defined as the product of cross-sectional area ($S_{rod}$) of the hollow rod 8 along the O-ring diameter (throttle 10) and the pressure differential value ($P_i$–$P_o$), i.e., $F_2=S_{rod}\cdot(P_i-P_o)$.

The decrease in peak torques acting on the bottom-hole motor (e.g., a screw bottom-hole motor) allows to avoid the motor operating in braking mode and thus to extend the service life thereof. Additionally, by providing optimal axial load on the drill bit with damping of longitudinal and rotational vibration acting on the bottom-hole structure, the service life of the drill bit can also be extended. On the other hand, a decrease in dynamic activity in the lower portion of the drilling string allows implementing a more sparing operation mode of the bottom-hole electronics of the rotary steerable system.

The areas of application of the device are not limited by the use thereof in a structure with a bottom-hole motor; the device can also be used in top drive drilling without the bottom-hole motor. In this case, the load on the drill bit generated by the device is determined by loss of working liquid pressure or by drilling bit jet nozzles or, if desired, by a choke installed below the device for said purpose.

Still another area of application of the device is milling where substantial jumps in the torque value occur.

As used herein, the term "configured" means that the element, component, or other subject matter is designed and/or intended to perform a given function. Thus, the use of the term "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa. Similarly, subject matter that is recited as being configured to perform a particular function may additionally or alternatively be described as being operative to perform that function.

The various disclosed elements of systems and other apparatuses disclosed herein are not required to all apparatuses according to the present disclosure, and the present disclosure includes all novel and non-obvious combinations and subcombinations of the various elements disclosed herein. Moreover, one or more of the various elements disclosed herein may define independent inventive subject matter that is separate and apart from the whole of a disclosed apparatus. Accordingly, such inventive subject matter is not required to be associated with the specific apparatuses that are expressly disclosed herein, and such inventive subject matter may find utility in apparatuses that are not expressly disclosed herein.

The invention claimed is:

1. A bottom-hole feeding mechanism comprising:

a cylinder (1), a screw spindle (2) coupled to the cylinder (1) by a non-stopping splined screw pair (3) and movable within the cylinder (1) during a drilling process;

a first piston (6) received within the cylinder (1) and coupled with the screw spindle (2) and a hollow rod (8);

an axial spindle (4) arranged along the cylinder (1) axis, coupled to the cylinder (1) by an axial splined pair (5) and movable within the cylinder (1) during a drilling process; and a second piston (7) rigidly coupled with the axial spindle (4) and engaging the inner surface of the cylinder (1) and the outer surface of the hollow rod (8), wherein the hollow rod (8), the first piston (6), the second piston (7) and the cylinder (1) form a closed chamber (9) comprising a throttle (10), a check valve (12) and hydraulic channels (11) on a body (21) of the check valve (12).

2. The bottom-hole feeding mechanism according to claim 1, wherein the first piston (6) comprises an O-ring (16).

3. The bottom-hole feeding mechanism according to claim 1, wherein the second piston (7) comprises an O-ring (18).

4. The bottom-hole feeding mechanism according to claim 1, wherein the first piston (6) and the second piston (7) are engaged with each other by compression springs (20) received within the closed chamber (9).

5. The bottom-hole feeding mechanism according to claim 1, wherein the outer diameter of the hollow rod (8) differs from the outer diameter of the first piston (6) and differs from the outer diameter of the second piston (7).

6. The bottom-hole feeding mechanism according to claim 1, wherein the cylinder (1) comprises at least one vent (15, 19).

7. The bottom-hole feeding mechanism according to claim 1, wherein the check valve (12) comprises a stopper (13) and a spring (14).

* * * * *